US006343786B1

(12) United States Patent
Gregoire et al.

(10) Patent No.: US 6,343,786 B1
(45) Date of Patent: Feb. 5, 2002

(54) UNJAMMING DEVICE FOR POSTAGE METER FEEDER

(75) Inventors: Jean-Pierre Gregoire, Brie Comte Robert; Thierry Le Jaoudour, Verriéres le Buisson, both of (FR)

(73) Assignee: Neopost Industrie, Bagneux (FR)

( * ) Notice: Subject to any disclaimer, the term of this patent is extended or adjusted under 35 U.S.C. 154(b) by 0 days.

(21) Appl. No.: 09/631,296

(22) Filed: Aug. 2, 2000

(30) Foreign Application Priority Data

Aug. 3, 1999 (FR) ..... 99 10066

(51) Int. Cl.[7] ..... B65H 5/02; B65H 5/04
(52) U.S. Cl. ..... 271/273
(58) Field of Search ..... 271/273; 399/124, 399/125

(56) References Cited

U.S. PATENT DOCUMENTS 4,861,018 A * 8/1989 Kerstein ..... 271/274
5,121,916 A * 6/1992 Sanchez ..... 271/272
6,234,693 B1 * 5/2001 Gregorie et al. ..... 400/33

FOREIGN PATENT DOCUMENTS

EP 0 724 234 A2 7/1996
JP 60 079 981 A 5/1985

* cited by examiner

*Primary Examiner*—Christopher P. Ellis
*Assistant Examiner*—Kenneth W Bower
(74) *Attorney, Agent, or Firm*—Sughrue Mion, PLLC

(57) ABSTRACT

Device for unjamming mail items retained in the transportation path of a mail handling machine, the mail items being transported by several series of drive rollers distributed all along this transportation path and at least two series of rollers (12, 14) of which are placed, with respect to the direction of advance of the mail items, respectively upstream and downstream of means (16) for printing the postal imprint. This device comprises manual control means in order, in a first position, to partly clear the transportation path for the mail items by simultaneously lowering the upstream and downstream drive rollers, and in order, in a second position, to completely clear the transportation path for the mail items by completely withdrawing all of the drive rollers.

11 Claims, 3 Drawing Sheets

10
12
14
16
18
22
24
26
28
30a
32a
34
38
40a
42a
44a
100
120
140
260
262
280
282
I A 44a
18
42a
44b
20
42b
34

UNJAMMING DEVICE FOR POSTAGE METER FEEDER

BACKGROUND OF THE INVENTION

The present invention relates exclusively to the field of the handling of mail and relates more particularly to an unjamming device for a postage metering machine or postage meter of the ink-jet type.

It is well known that, for various technical reasons, jamming phenomena may occur in postage meters. However, these problems are more critical or less critical depending on the architecture of the machine and especially on the possibility of gaining access to the path along which the mail items are transported.

In current machines, like those shown in the Applicant's French Patent Applications N°. 99 00492 and N°. 99 00493, the design requirements, both technical requirements (need for a compact and safe machine) and economical requirements (the postal imprint is a monetary value and the cost of the machine must be reasonable), do not allow the complete opening of the machines to be and do not allow them to be hinged in two separate parts as was possible on certain machines of older design. In addition, since the operating rates of these machines are becoming higher and higher, it is essential that any jamming problem be solved very quickly, that is to say directly by the user without having any recourse to an engineer of the company or to the After Sales Service of the manufacturer or of the licensor of the postage meter.

SUMMARY OF THE INVENTION

The objective of the present invention is to remedy these drawbacks by providing an unjamming device which facilitates access to the jammed area in order to remove the item or items of mail which have piled up there. An objective of the invention is also to make this intervention particularly easy, both for an envelope which is stuck but remains visible in the transportation path and for a label wedged in the rollers of this path and invisible from outside the machine.

These objectives are achieved by a device for unjamming mail items retained in the transportation path of a mail handling machine, the mail items being transported by several series of drive rollers distributed all along this transportation path and at least two series of rollers of which are placed, with respect to the direction of advance of the mail items, respectively upstream and downstream of means for printing the postal imprint, which device comprises a manual control unit in order, in a first unjamming position, to partly clear the transportation path for the mail items by simultaneously lowering the upstream and downstream drive rollers and in order, in a second unjamming position, to completely clear the transportation path for the mail items by almost completely withdrawing all of the drive rollers.

Thus, depending on the nature of the jamming, the operator will almost completely or partly withdraw the device for transporting the mail items. This operation is particularly quick and requires no intervention by an expert.

The series of drive rollers are each mounted on a common spindle, the ends of which are fastened to two parallel walls forming side panels and are able to move translationally under the action of said manual control unit. These parallel walls each have, at one end, a guiding point intended to engage in a slot made in a body of the mail handling machine so as to fulfill a realignment function.

Preferably, the movement of the side panels is obtained by mean s of castors which can move along slideways in the body of the mail handling machine. This movement of the castors along the slideways is limited by end-of travel stops so as to prevent complete withdrawal of the drive rollers.

The manual control unit comprises two parallel beams, the first ends of which are joined together by a handle directly actuable by an operator, the free second ends of these two beams, held in place by a brace, each terminating in a stop-forming lug intended to engage in a fixed part fastened to said walls forming the side panels.

The longitudinal beams include a ramp intended to engage by sliding with a linkage shaft integral in its movement with the upstream and downstream drive rollers. Advantageously, this ramp comprises three cam portions with decreasing slopes.

The walls forming the side panels and supports for the drive rollers are held in an initial printing position by a disengagable locking mechanism. Preferably, this disengagable locking mechanism comprises a part forming a ledge in permanent contact with a flexible unlocking blade which forms an integral part of the handle. Said disengagable locking mechanism also includes an element in the form of a fork which is incorporated into said part forming a ledge and which can pivot against a spring means on a linkage shaft mounted between said walls forming the side panels and having two locking hooks intended to engage in alignment openings made in the body of the machine.

BRIEF DESCRIPTION OF THE DRAWINGS

Further features and advantages of the present invention will become clearer from the following description, given by way of nonlimiting indication, with regard to the appended drawings in which.

DETAILED DESCRIPTION OF A PREFERRED EMBODIMENT

Figure 1:
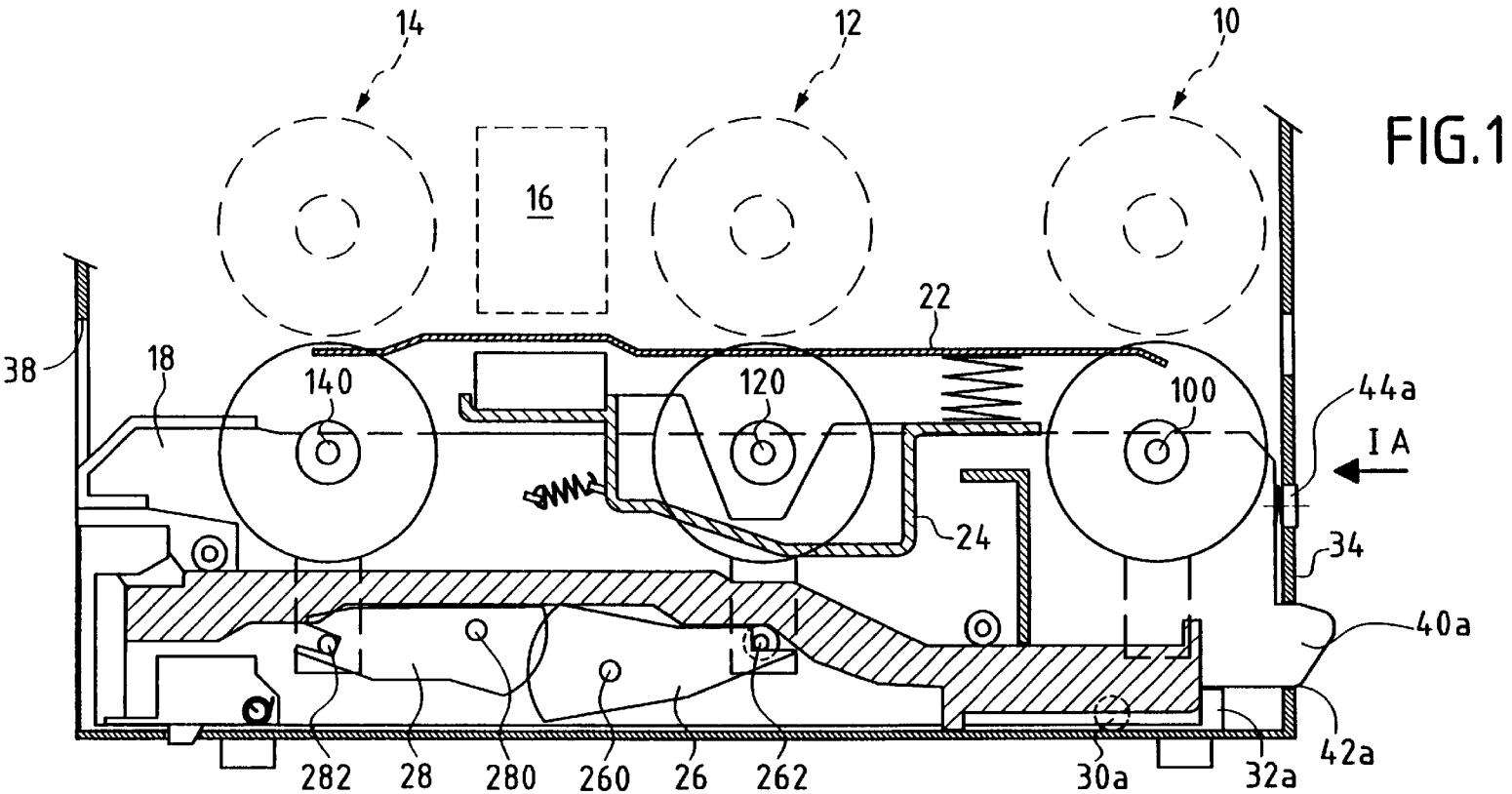
FIG. 1 is a longitudinal sectional view of the lower part of a transportation device for a postage meter which includes an unjamming device according to the invention.

The present invention is particularly applicable in mail handling machines, especially in postage meters provided with transportation devices such as those described in the Applicant's French Patent Applications N°. 99 00492 and N°. 99 00493.

In these transportation devices, and as illustrated in FIGS. 1 to 5, the mail items are in general driven along the transportation path of the machine by several series of superposed drive rollers one after another all along this transportation path, at least one first series of rollers 10 being placed at the entry of the transportation device in order to ensure, by interacting with a channel (not shown), selection of the mail items and at least two other series of rollers 12, 14 (also called upstream and downstream rollers) being placed on either side of means 16 for printing the postal imprint in order to ensure precise guiding during the printing. Each series of rollers is mounted on a common spindle 100, 120, 140, the two ends of which are fastened to two parallel walls 18, 20 forming the vertical side panels supporting the transportation device.

When the mail items are not in direct engagement with these various drive rollers they rest on a moveable table 22 of the transportation device, said moveable table being advantageously provided with a pivoting cradle 24 and the vertical movement of the moveable table being synchronized with the lowering of these drive rollers.

Furthermore, in order to distribute the pressures exerted on the mail items more evenly, especially depending on the various thickness of these items, and to reduce the shocks on the downstream drive rollers, the lowering of these two series of rollers, the upstream rollers 12 and the downstream rollers 14, is synchronized by means of two pairs of pivoted levers, respectively 26, 28, having two toothed sectors in mutual engagement, and the respective pivoting of which is coupled (essentially proportionally and in the ratio of the toothed sectors) to the movement of the series of rollers to which the lever is intimately associated. In fact each lever, which can pivot about a pivot pin 260, 280 fastened to the side panels 18, 20 of the transportation device, has, at one end, a gripping element which engages with an associated linkage shaft 262, 282 whose axis is parallel to the common spindle 120, 140 of the upstream drive rollers 12 and downstream rollers 14, and the movement of which follows exactly that of this common spindle to which it is fastened.

Figure 1A:
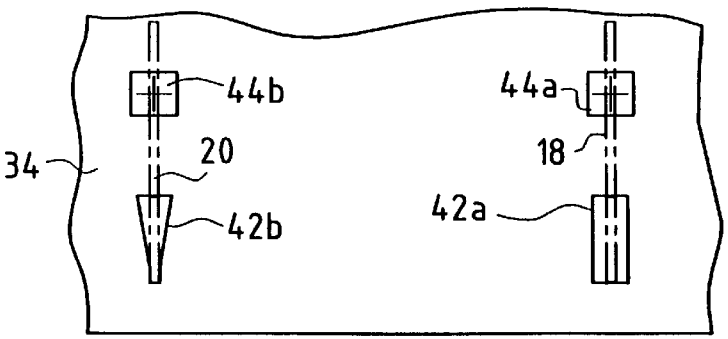
FIG. 1A is a detailed view illustrating realignment slots of the transportation device in FIG. 1.

According to the present invention, the entire transportation device (with its drive rollers and its moveable table) can move translationally, between an initial printing position and a final unjamming position, by means of castors 30*a,* 30*b* which are mounted on the two parallel vertical side panels 18, 20 for supporting the device and which can move along respectively slideways 32*a,* 32*b* of the body 34 of the postage meter, in such a way that the transportation device can be almost entirely removed from the postage meter (end-of-travel stops 36*a,* 36*b* limiting, however, the movement of the castors along the slideways so as to prevent complete withdrawal of the transportation device), through an opening 38 formed in its rear part (with respect to the direction of advance of the mail items). Each of the side panels 18, 20 is provided at its front end with a guiding point 40*a,* 40*b* intended to engage at the end of the return travel (and therefore in the printing position) in a slot 42*a,* 42*b* made in part of the body 34, one 42*a* of these two slots fulfilling, by a precisely adjusted part at the corresponding guiding point, a function of realigning the transportation device (see FIG. 1A). In the printing position, the side panels 18,are then positioned against the body 34 of the postage meter and push back spring means, for example, compression leaf springs 44*a,* 44*b*.

The transportation device is moved in the body of the postage meter by a manual control unit 46 provided with a handle 48 which acts on a disengagable locking mechanism 50.

The manual control unit 46 is in the form of a bottomless drawer with essentially two parallel beams 52, 54, the first ends of which are joined together by the handle 48, the free second ends of these two beams being held parallel by a brace 49 and each terminating in a stop-forming lug 56, 58 intended to engage in a fixed part 60 fastened to the side panels 18, 20. In an intermediate region, between these first and second ends, the beams each have a ramp 62, 64 advantageously comprising three cam portions with decreasing slopes, steeply-sloped cams 62, 64*a,* moderately-sloped cams 62*b,* 64*b* and gently-sloped cams 62*c,* 64*c* respectively, which engage by sliding with the first linkage shaft 262 associated with the series of upstream rollers 12. Two guiding spindles (or two pairs of wheels) 66, 68, mounted between the supporting side panels 18, and preferably placed close to the two ends of the beams, may furthermore be added in order to perfect the guiding of these beams during the movement of the transportation device in the machine.

The disengagable locking mechanism 50 comprises a piece substantially in the form of a lifting fork, the bearing part of which, forming the ledge 70, is in permanent contact with a flexible unlocking blade 72, which forms an integral part of the handle 48, and the two parallel and flat teeth of which pivot on a linkage shaft 74, against a spring means, for example two return springs 76, 78. Each of these two teeth has, at the bottom, a lug which forms a locking hook 80, 82 and which, by engaging in an alignment opening 84, 86 in the body of the postage meter, keeps the transportation device in the initial printing position. In this position, the side panels 18,are in contact with the body 34 and push back the compression leaf springs 44*a,* 44*b*.

The unjamming procedure is carried out as follows. In normal operation (FIG. 1), the transportation device is completely housed in the body (also called the "base") of the postage meter in an initial position allowing the postage imprint to be printed, the handle 48 then being simply flush with the machine and the leaf springs 44*a,* 44*b* being compressed. The drive rollers and the moveable table are in a high position and the first linkage shaft 262 is in contact with the steeply-sloped cam portion 62*a,* 64*a* of the beams 52, 54.

Figure 2:
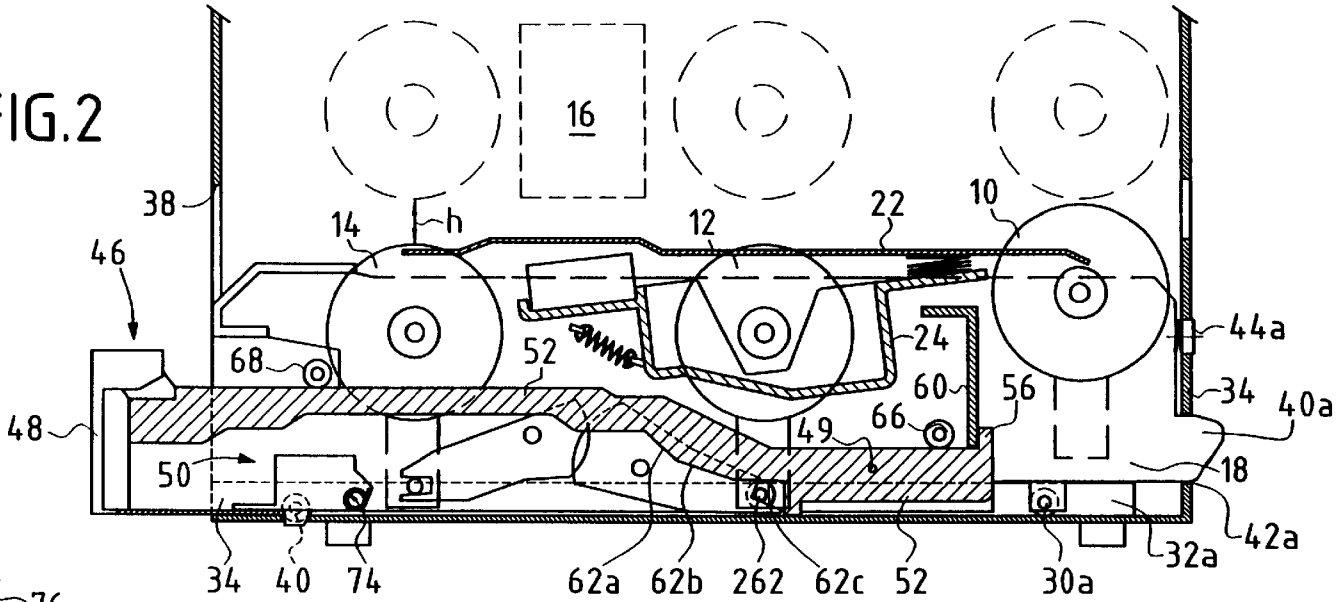
FIG. 2 is a view similar to that of FIG. 1 with the unjamming device in a first position for partially clearing the transportation path for mail items.
Figure 4:
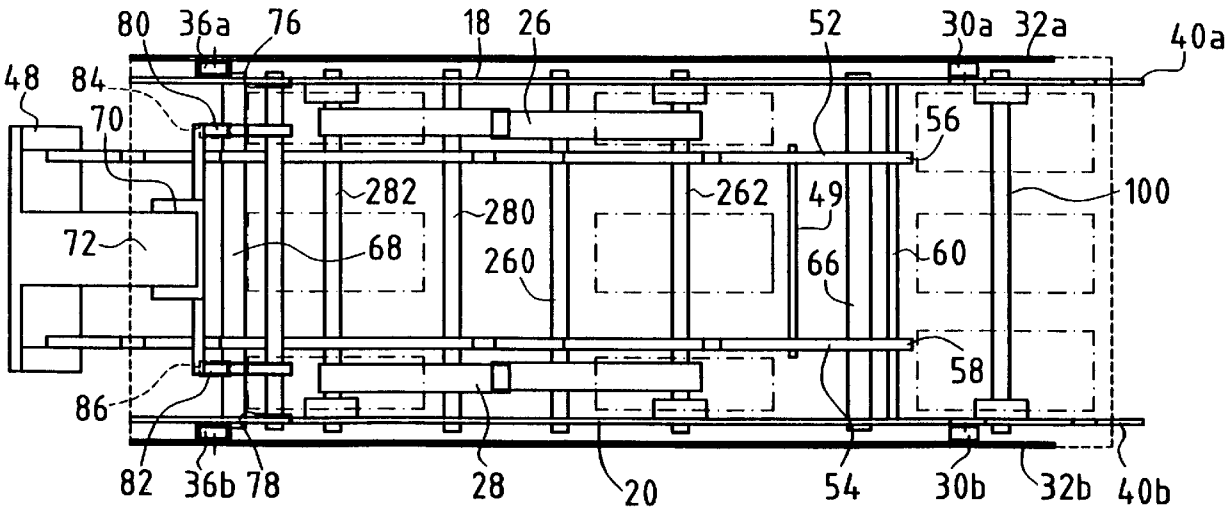
FIG. 4 is a view from below of the device in FIG. 2, with the body of the transportation device remove.

If a jam occurs the operator will firstly pull on the handle 48 (FIG. 2) in order to partly clear the transportation path for the mail items. The beams 52, 54 fastened to this handle, by moving, lower the first linkage shaft 262 (which follows the slope imposed by the ramp 62, 64) and simultaneously lowers the upstream drive rollers 12 and the downstream drive rollers 14, via the pivoted levers 26, 28. This is because the two pivoted levers mutually interact in such a way that pivoting of the first lever associated with the upstream rollers in a defined direction of rotation causes the second lever associated with the downstream rollers to pivot in the opposite direction of rotation. The successive decrease in the slopes of the cam portions allows the tensile force exerted on the lever to be varied (high at the start and lower thereafter). When the stop-forming lugs 56, 58 come into contact with the fixed partition 60, the beams are immobilized in a first unjamming position. In this intermediate position, the first linkage shaft 262 is in an extremely low position in contact with the gently-sloped cam portion 62*c,* 64*c* and the upstream and downstream rollers 12, 14, also lying in a low position (as is the moveable table 22), clearing the transportation path over a defined height h sufficient for the operator to be able to pass his hand between the drive rollers (FIG. 2). This position is therefore particularly suitable for envelopes stuck in the transportation path and relatively easy to get at.

Figure 3:
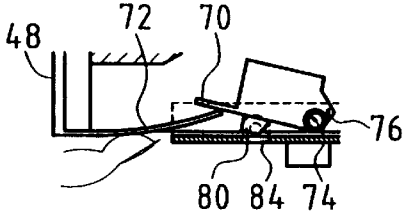
FIG. 3 is a detailed view illustrating the locking mechanism of the unjamming device.
Figure 5:
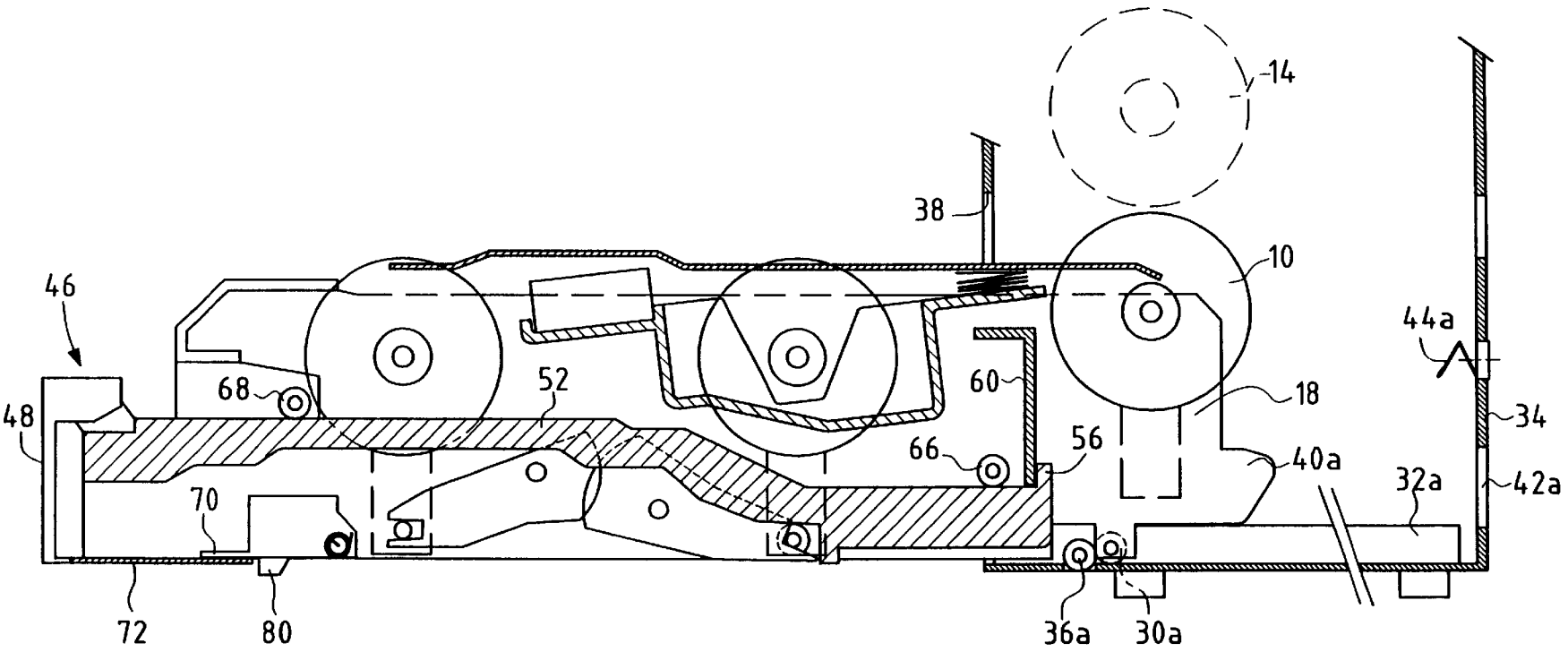
FIG. 5 shows the unjamming device in a second position, for completely clearing the transportation path for the mail items.

If the cleared space proves not to be sufficient to get at the blocked item, for example when it is a question of removing a label not easily locatable in this transportation path, the operator will then, secondly, clear the entire transportation path by completely withdrawing all the drive rollers 10, 12, 14. To do this, and as shown in FIG. 3, he raises, with his fingers, the flexible unlocking blade 72. This action causes the fork to tilt about the linkage shaft 74 and raises the locking hooks, 80, 82, thereby clearing the transportation device which now requires only to run along its slideways, the more so because the leaf springs 44*a,* 44*b,* being relaxed, give an initial impulse to the movement of the transportation device. The complete movement is then accomplished by pulling on the handle 48 until the castors 30*a,* 30*b* come to stop on the end-of-stops 36*a,* 36*b* (FIG. 5). In this second unjamming end position, the operator can then recover the label that was stuck and once this operation has been carried out he can push back the transportation device with the handle so that it resumes the initial printing position. The ramp 62, 64 having traveled in the opposite direction allows the drive rollers and the moveable table to rise in order to resume their initial high positions, by passing through the intermediate unjamming position, the final guiding of the transportation device being provided by the action in the realignment slot.

Thus, with the structure of the invention, the unjamming operation is carried out very simply, if necessary in two successive steps which correspond respectively to an easy intermediate intervention (for example in the case of a visible envelope) and to a less immediate intervention but one which, nevertheless, remains still relatively easy (in the case of a label which is not visible).

What is claimed is:

1. A device for unjamming mail items retained in the transportation path of a mail handling machine, the mail items being transported by several series of drive rollers distributed all along this transportation path and at least two series of rollers (12, 14) of which are placed, with respect to the direction of advance of the mail items, respectively upstream and downstream of means (16) for printing the postal imprint, which device comprises a manual control unit (46, 50) in order, in a first jamming position, to partly clear the transportation path for the mail items by simultaneously lowering the upstream and downstream drive rollers and in order, in a second jamming position, to completely clear the transportation path for the mail items by almost completely withdrawing all of the drive rollers.

2. The unjamming device as claimed in claim 1, wherein said series of drive rollers are each mounted on a common spindle (100, 120, 140), the ends of which are fastened to two parallel walls forming side panels (18, 20) and are able to move translationally under the action of said manual control unit.

3. The unjamming device as claimed in claim 2, wherein each of said parallel walls forming side panels has at one end a guiding point (40*a,* 40*b*) intended to engage in a slot (42*a,* 42*b*) made in part of the body (34) of the mail handling machine so as to fulfill a realignment function.

4. The unjamming device as claimed in claim 2, wherein said parallel walls forming side panels and supports for the drive rollers are able to move translationally by means of castors (30*a,* 30*b*) which can move along slideways (32*a,* 32*b*) in the body (34) of the mail handling machine.

5. The unjamming device as claimed in claim 4, wherein the movement of the castors along the slideways is limited by end-of-travel stops (36*a,* 36*b*) so as to prevent complete withdrawal of the drive rollers.

6. The unjamming device as claimed in claim 2, wherein said manual control unit comprises two parallel beams (52, 54), the first ends of which are joined together by a handle (48) directly actuable by an operator, the free second ends of these two beams, held in place by a brace (49), each terminating in a stop-forming lug (56, 58) intended to engage in a fixed part (60) fastened to said walls forming the side panels.

7. The unjamming device as claimed in claim 6, wherein said longitudinal beams include a ramp (62, 64) intended to engage by sliding with a linkage shaft (262) integral in its movement with the upstream and downstream drive rollers (12, 14).

8. The unjamming device as claimed in claim 7, wherein said ramp comprises three cam portions with decreasing slopes (62*a,* 62*b,* 62*c;* 64*a,* 64*b,* 64*c*).

9. The unjamming device as claimed in claim 1, wherein said walls forming the side panels and supports for the drive rollers are held in an initial printing position by a disengagable locking mechanism (50).

10. The unjamming device as claimed in claim 9, wherein said disengagable locking mechanism comprises a part forming a ledge (70) in permanent contact with a flexible unlocking blade (72) which forms an integral part of the handle (48).

11. The unjamming device as claimed in claim 10, wherein said disengagable locking mechanism includes an element in the form of a fork which is incorporated into said part forming a ledge and which can pivot against a spring means (76, 78) on a linkage shaft (74) mounted between said walls forming the side panels and having two locking hooks (80, 82) intended to engage in alignment openings (84, 86) made in part of the body (34) of the machine.

* * * * *